United States Patent [19]

McGourty, Jr. et al.

[11] 4,438,604

[45] Mar. 27, 1984

[54] INTERIOR DECORATION SYSTEM

[76] Inventors: Lawrence E. McGourty, Jr.; Gabriel Audette; Jean M. Audette, all of c/o Woodcraft Industries, Ltd., 7 High St., Hudson, Mass. 01749

[21] Appl. No.: 275,252

[22] Filed: Jun. 19, 1981

[51] Int. Cl.[3] ..... A47B 5/00

[52] U.S. Cl. ..... 52/28; 52/36; 248/222.4; 248/224.4

[58] Field of Search ..... 52/36, 29, 27, 6, 28, 52/220, 221, 222, 262, 267, 484, 288, 811; 108/108, 110, 144, 152; 248/220.1, 222.1, 222.2, 225.1, 224.4, 225.2, 215–243; 362/133, 127, 125, 457; 211/88, 190

[56] References Cited

U.S. PATENT DOCUMENTS

| | | | |
|---|---|---|---|
| 3,462,892 | 8/1969 | Meyer | 52/221 |
| 3,471,978 | 10/1969 | Fenwick | 52/2 |
| 3,621,635 | 11/1971 | De Lange | 52/811 |
| 4,008,807 | 2/1977 | Phillips | 248/224.4 |
| 4,074,489 | 2/1978 | Eckel | 52/288 |
| 4,211,379 | 7/1980 | Morgan | 52/36 |

OTHER PUBLICATIONS

"Illuminating Engineering" Published Nov. 1950, p. 715.

*Primary Examiner*—Price C. Faw, Jr.
*Assistant Examiner*—Kathryn L. Ford
*Attorney, Agent, or Firm*—Blodgett & Blodgett

[57] ABSTRACT

System for decoration of interior walls consisting of a panel to be located adjacent a structural wall, a plurality of first brackets mounted on the structural wall, and a plurality of second brackets mounted on the rear surface of the panel.

9 Claims, 14 Drawing Figures

FIG. 10
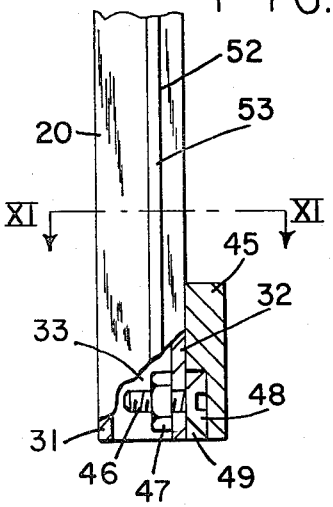
FIG. 11
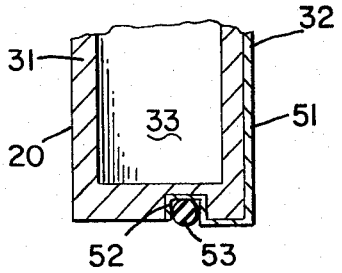
FIG. 12
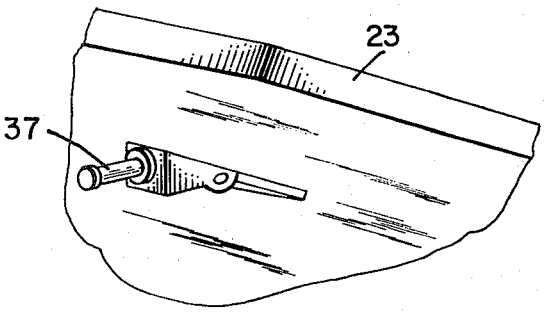
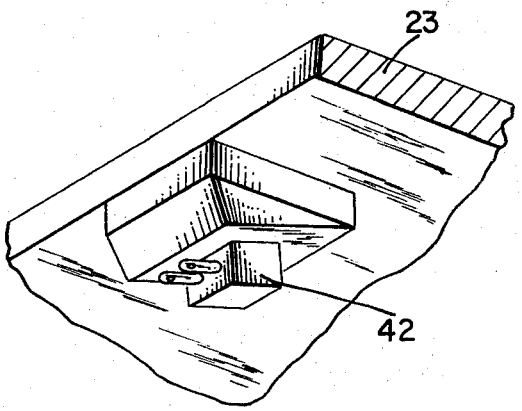
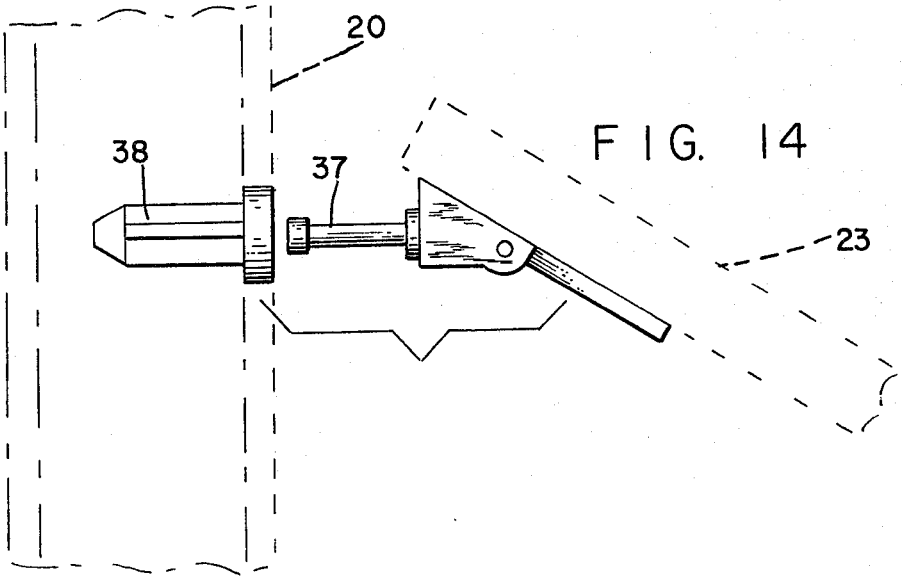
FIG. 14

INTERIOR DECORATION SYSTEM

BACKGROUND OF THE INVENTION

In the operation of a retail store, there have traditionally been a number of problems that concern its decoration. For one thing, when the store is initially built, the lessee (the store owner) is allowed to begin the decoration of the store only after his lease from the owner of the building has begun. This means that, under time-honored construction methods, the decoration of the store is brought about during the time when the lessee is paying rent. The installation of the decorations takes a long time, because it has to be done more-or-less manually. Also, when the lease is ended, the decorative material that has been added to the store is usually part of the real estate and must be left behind. Therefore, the store owner experiences a loss in this regard. Finally, if the store owner wishes to move the decoration and decor within the store, a very expensive rebuilding project must be undertaken. There are certain times of the year, for instance, when it is desirable to move one part of the store into a more accessible location within the store. These and other difficulties experienced with the prior art devices have been obviated in a novel manner by the present invention.

It is, therefore, an outstanding object of the invention to provide an interior decoration system which can be quickly installed in a raw store space.

Another object of this invention is the provision of a system for interior decoration which permits moving portions of the wall decoration and furniture into various locations within the store without a complete redecoration project.

A further object of the present invention is the provision of an interior decoration system for a store which allows the store to be standardized throughout the various outlets of a chain, so that the interior of the store becomes a readily-recognized element of the store that the customers find familiar.

It is another object of the instant invention to provide a method of quickly and easily attaching and lighting display shelves within a retail store.

A still further object of the invention is the provision of a system for store interior decoration involving electrical outlets, wherein the elements of the system do not constitute parts of the permanent electrical circuitry of the store and, therefore, may be removed when the lease terminates.

It is a further object of the invention to provide an interior decoration system in which the elements do not become part of the rear estate and, therefore, is the personal property of the store owner when the lease expires.

With these and other objects in view, as will be apparent to those skilled in the art, the invention resides in the combination of parts set forth in the specification and covered by the claims appended hereto.

SUMMARY OF THE INVENTION

In general, the invention consists of an interior decoration system including a panel located adjacent a structural wall. A plurality of vertically-spaced first brackets are mounted on the structural wall. A plurality of vertically-spaced second brackets are mounted on the rear surface of the panel and are locked with the first brackets to hold the panel in fixed relationship with the structural wall.

More specifically, the panel is formed with an interior recess and an electrical circuit is contained in the recess. Shelves are mounted on the front surface of the panel, each shelf having a plurality of male elements that removably lock into female elements forming parts of the panels proper. A lighting fixture is mounted on the undersurface of each shelf and an electrical outlet is located on the front surface of the panel for connection to the lighting fixture.

BRIEF DESCRIPTION OF THE DRAWINGS

The character of the invention, however, may be best understood by reference to one of its structural forms, as illustrated by the accompanying drawings, in which:

FIG. 10 is a side view of a lower portion of the panel with a portion broken away, FIG. 11 is a horizontal sectional view of a portion of the panel taken on the line XI—XI of FIG. 10, FIG. 12 is a perspective view of a male member associated with a shelf, FIG. 13 is a perspective view of an electrical connector forming part of the invention, and FIG. 14 is a side elevational view of male and female elements associated with the panel and shelves.

DESCRIPTION OF THE PREFERRED EMBODIMENT

Figure 1:
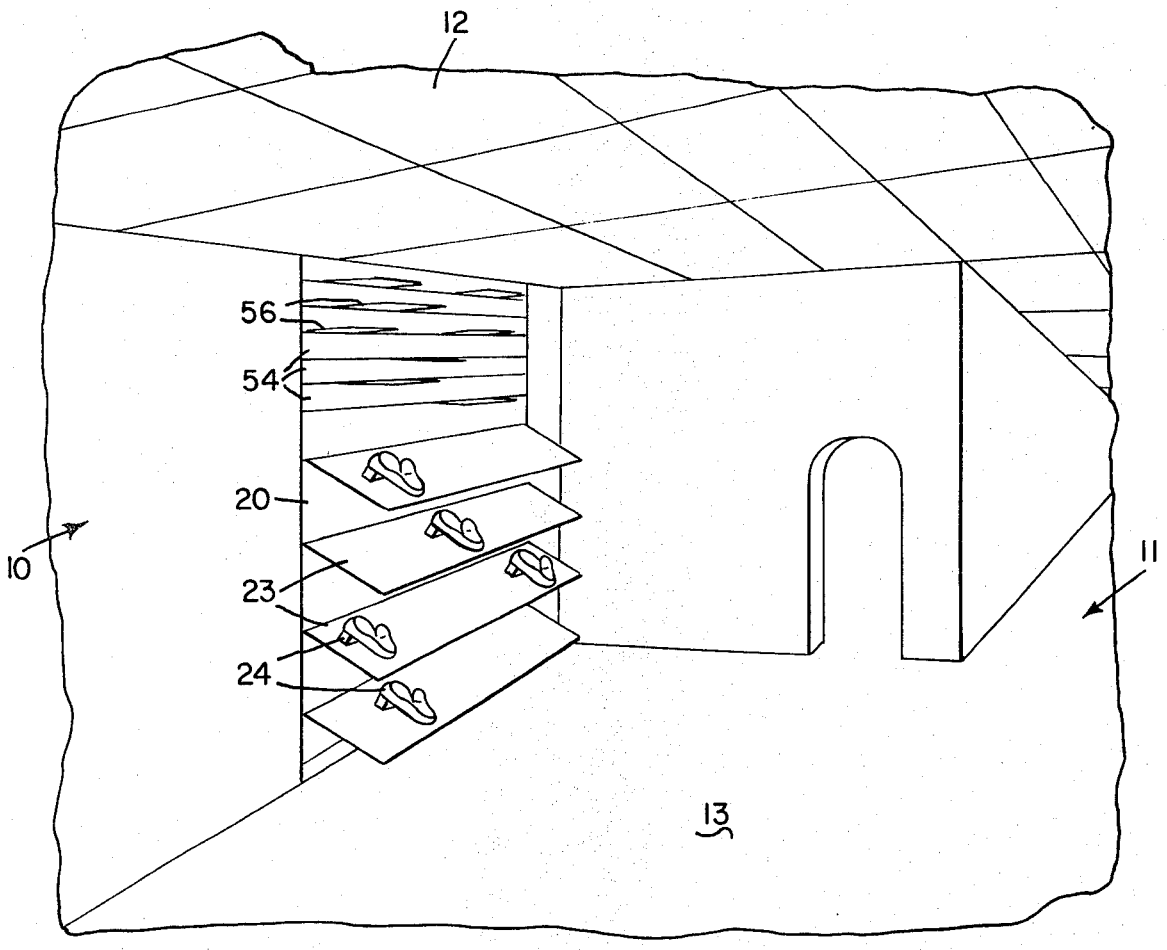
FIG. 1 is a perspective view of a retail store incorporating an interior decoration system constructed in accordance with the principles of the present invention.
Figure 2:
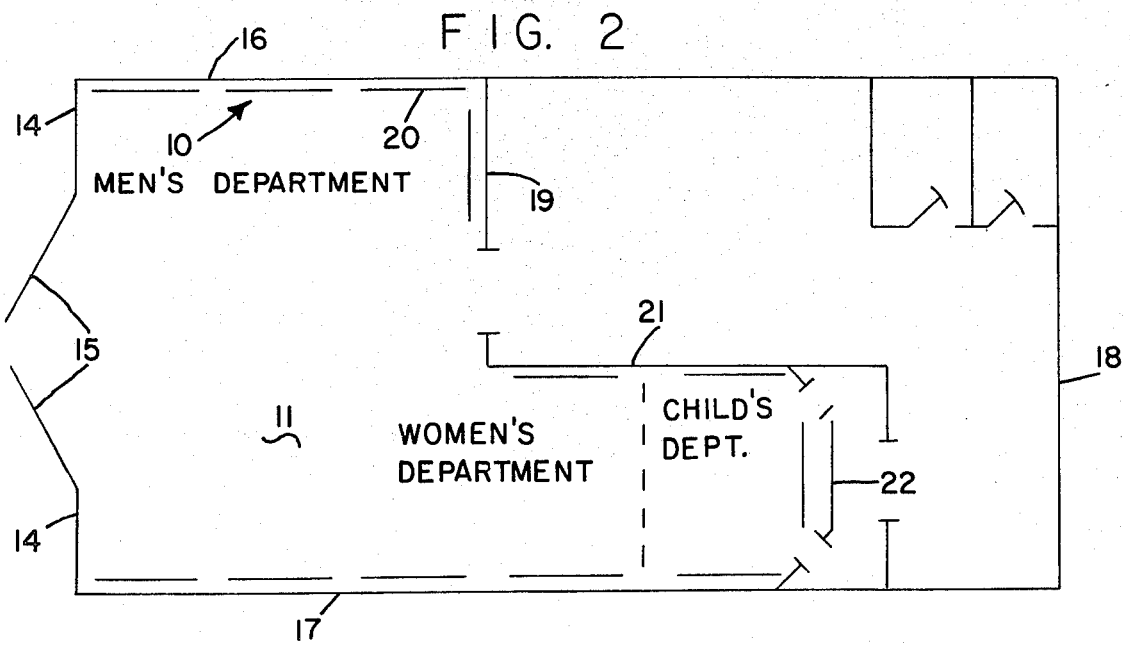
FIG. 2 is a plan schematic view of the store.

Referring first to FIGS. 1 and 2, which best show the general features of the invention, the interior decoration system, indicated generally by the reference numeral 10, is shown in use in a retail store 11. For the purpose of illustration, the store is shown as devoted to the sale of shoes. The store is provided with a ceiling 12 and a floor 13. Joining the floor to the ceiling are a front window 14 with an entrance door 15, side walls 16 and 17, rear wall 18, and interior wall 19, 21, and 22. The side walls and the rear wall, as well as the interior walls 19, 21, and 22, are formed of cinder block in the usual way and these walls are shown as covered with a plurality of panels of which the panel 20 is a typical example. The panel 20 is located adjacent the side wall 16 and is attached thereto.

Figure 3:
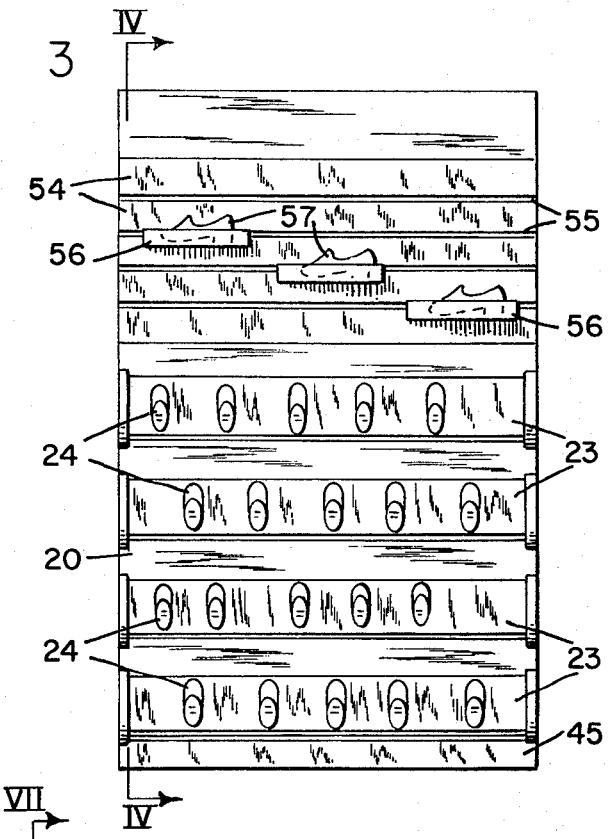
FIG. 3 is a front elevational view of a panel forming part of the invention.

As is evident in FIG. 3, the panel 20 is provided with shelves 23 on which are displayed the product being sold which, in the case of a shoe store, are shoes 24. As is evident in FIG. 2, the store 11 is laid out to provide a MEN'S DEPARTMENT, a WOMEN'S DEPARTMENT, and a CHILD'S DEPARTMENT, each department having its own distinctive panels 20 and shelves 23 carrying the type of product that is sold in that particular portion of the store.

Figure 4:
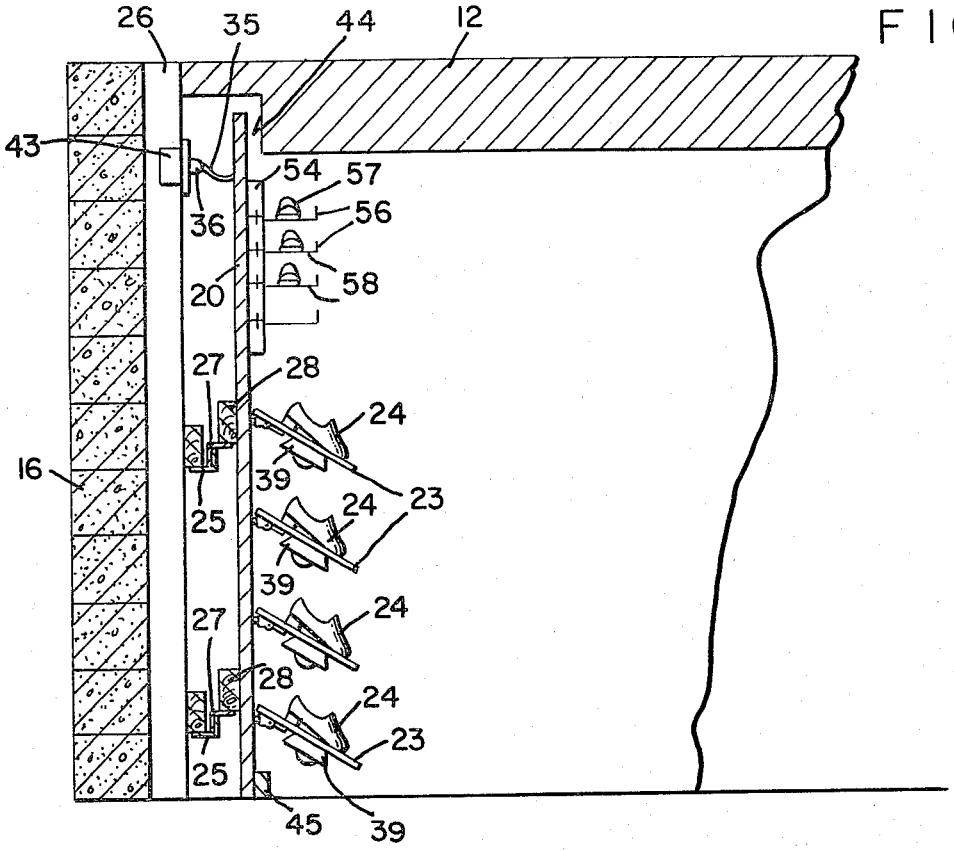
FIG. 4 is a sectional view of the panel taken on the line IV—IV of FIG. 3.
Figure 8:
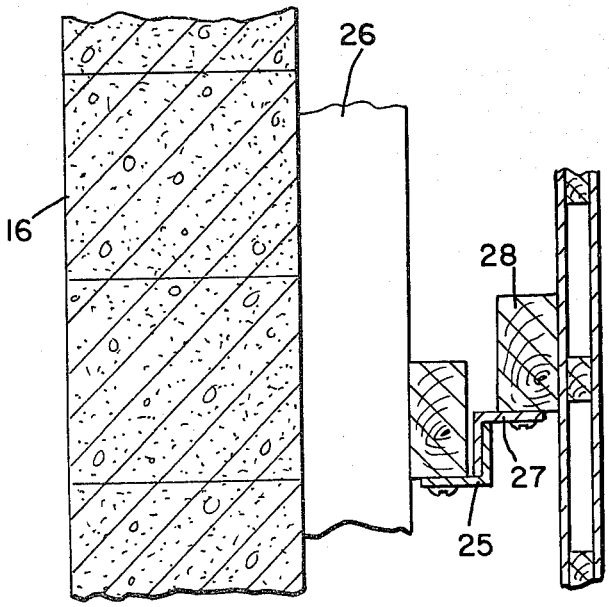
FIG. 8 is an enlarged vertical sectional view of a portion of the panel.

Referring next to FIGS. 4 and 8, it can be seen that a plurality of vertically-spaced first brackets 25 are mounted on 2×4 beams 26 which in turn are attached to the cinder block of the wall 16. Furthermore, a corresponding set of vertically-spaced second brackets 27 are mounted on the panel 20 by means of 2×4 beams 28 attached to the rear surface of the panel.

Figure 6:
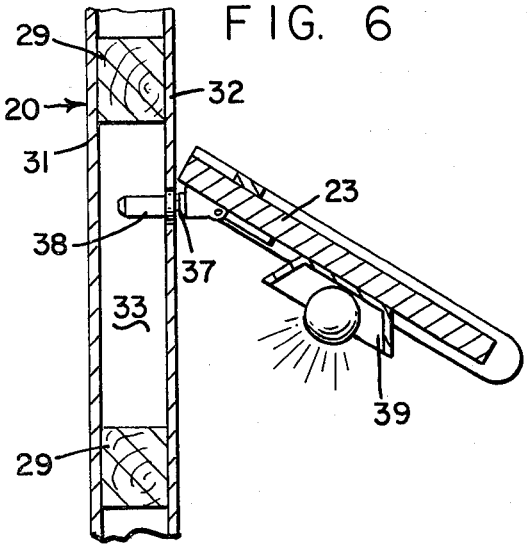
FIG. 6 is a vertical sectional view of the panel and shelf, taken on the line VI—VI of FIG. 5.
Figure 7:
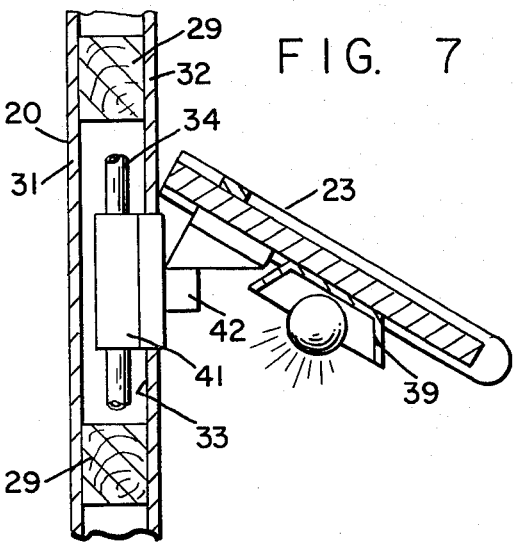
FIG. 7 is a vertical sectional view of the panel taken on the line VII—VII of FIG. 5.

As is best evident in FIGS. 6 and 7, each panel 20 is formed with an interior framework 29 that is covered on the front and back sides with rigid sheets 31 and 32. The framework provides an interior recess 33 which extends vertically through the length of the panel 20. Extending from top to bottom of the recess is an electrical circuit 34, which terminates at the upper portion in a flexible cable 35 (see FIG. 4) at the end of which is mounted a conventional electrical plug 36.

Figure 5:
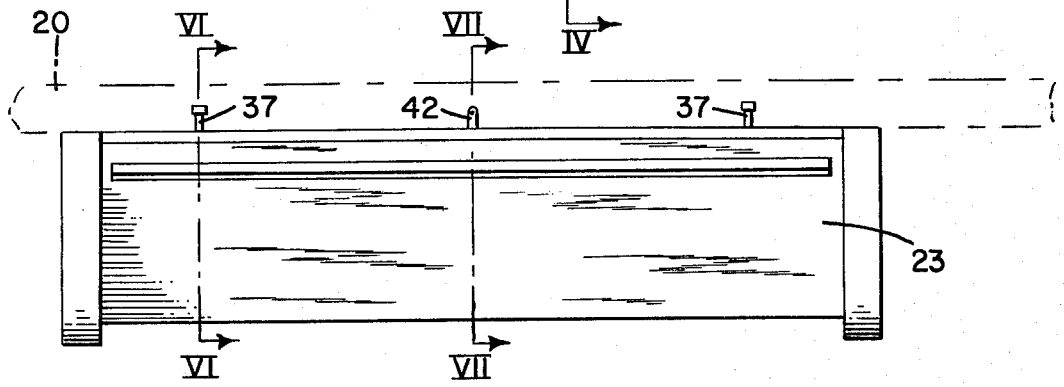
FIG. 5 is a plan view of a shelf used in the invention.

Referring next to FIGS. 5, 6, and 7, it can be seen that each shelf 23 is provided with a plurality of male elements 37 that removably lock into female elements 38 fastened into the panel 20. A lighting fixture 39 (in the form of a strip fluorescent lamp) is mounted on the undersurface of each shelf. An electrical outlet 41, forming part of the electrical circuit 34, is mounted and exposed to the front surface of the panel and is connected to the lighting fixture. In other words, the lighting fixture 39 includes an electrical connector 42 which has prongs extending horizontally into the outlet 44. The male elements 37 and the electrical connector 42 are mounted adjacent the edge of the shelf closest to the panel 20 and the shelf extends at an acute angle to the horizontal. Therefore, the male elements and the prongs of the connector also extend at an acute angle to the undersurface of the shelf.

In FIG. 4, it can be seen that a permanent electrical outlet 43 is mounted on the beams 26 associated with the structural wall 16. The flexible cable 36 extends rearwardly of the panel 20 at the same level as the outlet 43, so that its plug 36 can be introduced into the outlet 43 to complete its circuit to all of the elements in the panel. Therefore, the only connections between the panel 20 and the structural walls 16 are the interlocking of the first and second brackets 25 and 27 and the interengagement of the flexible cable 35 with the said permanent electrical outlet 43.

FIG. 4 also shows the manner in which the ceiling 12 is formed to permit the introduction of the panel. As is evident in the drawings, the ceiling 12 is of the drop-ceiling type with panels and strip lamps provided in the usual manner. However, adjacent each of the walls, including the wall 16, the ceiling is provided with an upwardly-directed recess 44. The trough or recess 44 is located immediately adjacent the structural wall 16 and the upper end of the panel 20 extends upwardly into the recess during the installation of the panel. The vertical depth of the trough is great enough to allow interengagement and disengagement of the brackets 25 and 27 as necessary.

Referring to FIGS. 3 and 10, it can be seen that the lower part of the panel 20 is provided with a removable mop board 45. The mop board is held in place by a bolt 46 which threadedly engages a nut 47 fixedly mounted in the panel 20. The bolt has a head 48 which is conical and this head engages a vertical groove 49 formed in the board, the groove being dove-tailed or V-shaped to receive the conical head 48.

As is evident in FIG. 11, the front face surface of the panel 20 is covered with a flexible decorative sheet 51 which may be in the form of wallpaper or felt. The sheet extends over the vertical edges of the panel 20 and has its ends residing in a groove 52 formed in the vertical edge of the panel. An elastomer strip 53 resides in each groove 52 to lock the sheet in place.

Figure 9:
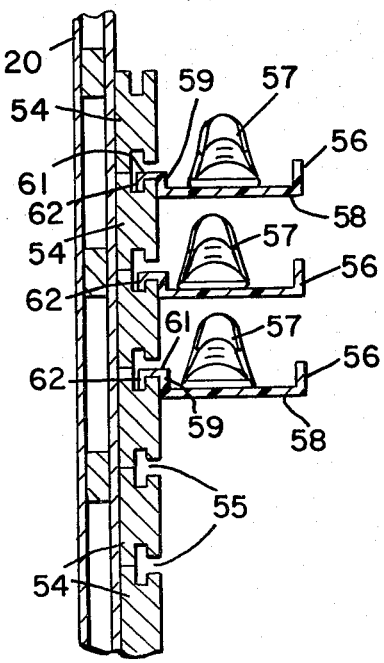
FIG. 9 is an enlarged vertical sectional view of another portion of the panel.

In FIGS. 3 and 9, it can be seen that the upper part of the panel 20 is provided with a plurality of slats 54 defining between them T-shaped slots 55. Shelves 56 are locked into the slots and extend forwardly of the panel to support merchandise 57 for display. In the preferred embodiment, each shelf 56 is formed of clear plastic and consists of a straight portion 58 which extends forwardly of the panel 20, a vertical portion 59 which lies against the outer surface of a slat, a short horizontal portion 61 lying in the leg of the T-shaped groove 55, and a short vertical portion 62 lying in an arm of the T-shaped groove.

FIG. 12 shows the manner in which each male element 37 is mounted on the undersurface of its shelf 23. FIG. 13 shows the manner in which each electrical connector 42 is similarly mounted on the undersurface of its shelf 23, the two elements extending at an acute angle to the said undersurface.

FIG. 14 shows the manner in which the element 37 and the female element 38 are related. The male element is provided with a slight enlargement by which it locks in place in the interior of the female element. The female element is formed of plastic and has an elastomer quality to permit withdrawal or locking on occasion.

The operation and advantages of the invention will now be readily understood in view of the above description. First of all, the store without decoration is provided in a standard form as a generally rectangular structure that is approximately three times as deep as it is wide. This is particularly true in a shopping mall. One narrow end has a window 14 and the door 15 for the admission of customers. This door would normally face toward the parking area of shopping mall. In order to install the present interior decoration system, it is necessary to provide the original raw walls with vertical 2×4 studs locked together with cross pieces. The cross pieces are provided with two levels of first bracket 25, as is evident in FIG. 8. The panel 20 is provided with cross beams 28 to which have been attached the second brackets 27. In order to mount the panel in place, the upper end of the panel is slid upwardly into the recess 44 in the ceiling 12, as is evident in FIG. 4. When it is in a raised position (with the lower end of the panel lifted off the floor), the cable 35 is attached by inserting the plug 36 into the outlet 43. The panel is then lowered so that the vertical flanges two sets of second angle-iron brackets 27 are inserted behind the first angle-iron brackets 25. Most of the weight of the panel, however, is carried by the bottom edge of the panel resting on the floor 13 of the store; the interlocking of the brackets 25 and 27 simply prevents the panel from moving away from the wall.

Once the panel has been installed in the method described above, it is now possible to mount the shelves 23. Each shelf is advanced toward the panel in such a way that the two male elements 37 enter the female elements 38 and are locked in place. At the same time, the prongs of the electrical connector 42 enter the conventional apertures in the outlet 41. The prongs and the male elements are located in such a way that the action or movement toward the panel serves to insert all three of them simultaneously. In the preferred embodiment, as shown in FIG. 5, there are two male elements 37 which are more-or-less adjacent the ends of the shelf 23 and the electrical connector 42 is located between the two of them. It can be seen then that, once the shelves have moved into place in this manner, the electrical connection from the outlet 43 through the cable 35, through the electrical circuit 34, the outlet 41, and the connector 42 to the fixture 39 completes the circuitry and the lights are energized. They can be controlled in the usual manner by switches that control the electricity at the permanent outlet 43. The merchandise or shoes 24 can now be placed on the shelves and they will be well lighted by the light on the shelf above them.

In the same way, the shelves 56 can be inserted in the T-shaped grooves 55 formed by the slats 54 and suitable merchandise 57 can be placed on these shelves. These shelves are usually located high on the panel and are lighted by suitable lamps forming part of the drop ceiling 12.

The mop board 45 can be moved into place and any adjustment necessary to keep the mop board tight can be provided by rotating the bolt 46 in its nut 47. It should be noted, of course, that, if the sheet 51 is to be used as part of the decoration to cover the panel, this sheet would be fastened in place before the panel is mounted on the wall. Once the sheets have been pulled tight around the front of the panel, the ends are locked in place by inserting the elastomer strip 53.

It can be seen, then, that the only time-consuming work to be done in preparing the store for use is the provision of the 2×4's or beams 26 and the cross-beams that go with them on the raw walls 16, 17, 19, 21, and certain parts of the wall 22 in the childrens department. The permanent wiring is then provided. When this rough work has been done, the ceiling 12 installed, and the carpet applied to the floor 13, the panels 20 can be moved into place. They can be assembled by non-union help and even by the personnel who will be operating the shoe store and they can be of a standard format. That is to say, the color of the sheet 51 on the panels in the MEN'S DEPARTMENT can be quite different from that in the WOMEN'S DEPARTMENT and the CHILD'S DEPARTMENT. In the latter department, for instance, there would probably be gay wallpapers carrying animals and cartoon characters, as is well known. These themes can be standard throughout a chain of stores, so that the interior decorator system, including the panels and shelves, can be manufactured in a factor under the best of conditions with automatic machinery and can be stored for later use. If the shoe store decides to move to another location or decides to terminate its lease, it may take the panels and the associated shelves 23 and 56 with them to the new location. Since it can be readily seen in the drawings that the panels and their associated equipment are not permanently part of the real estate, they would legally be considered personal property and would not belong to the owner of the building. Another advantage of the present invention is that the panels can be removed and relocated in a different part of the store on certain occasions. It might be desirable, for instance, to place the CHILDREN'S DEPARTMENT or the WOMEN'S DEPARTMENT close to the door 15 at Christmas or Easter time, in which case the MEN'S DEPARTMENT would be moved further back into the store. This change can be accomplished by making use of store personnel. There is no need for union help nor is any particular skill required to do so. The greatest saving in cost experienced with the present system is that the time for the initial installation is so short. Once the lease has begun, the installers can move in, install the equipment in a very short while with very little loss of "selling time" in the store. This is a decided contrast to the former situation where all of the walls and decorations were installed on the site and the store was out of operation for a very long time. This was also true, of course, in redecorating the store, because it was necessary to cease operations entirely. With the present invention, any redecoration can take place outside of the normal store hours and new panels and equipment can be brought into the store during the night, so that the store would experience no loss of sales time at all.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Interior decoration system, comprising:

(a) a panel located adjacent a structural wall, (b) a plurality of vertically-spaced first brackets mounted on the structural wall, (c) a plurality of vertically-spaced second brackets mounted on the rear surface of the panel and locking with the first brackets to hold the panel in fixed relationship to the structural wall, a plurality of shelves being mounted on the front surface of the panel, each shelf having a plurality of male elements that removably lock into female elements, and (d) a lighting fixture mounted on the undersurface of each shelf, an electrical outlet being located at the front surface of the panel for connection to the lighting fixture, the lighting fixture including an electrical connector having prongs mounted on the undersurface of the shelf, the male members and the electrical connector being mounted adjacent one edge of the shelf, the male members and the prongs of the electrical connector extending at an acute angle to the undersurface of the shelf.

2. Interior decoration system as recited in claim 1, wherein the panel is formed with an interior recess, and wherein an electrical circuit is contained in the recess.

3. Interior decoration system as recited in claim 2, wherein a permanent electrical outlet is mounted on the structural wall, and wherein a flexible cable extends from the rear of the panel and is operatively connected to the said electrical circuit in the panel, so that the sale connections between the panel and the structural wall consist of the interlocking of the first and second brackets and the interengagement of the flexible cable and the said permanent electrical outlet.

4. Interior decoration system as recited in claim 1, wherein the structural wall joins a drop ceiling, the ceiling being formed with an upwardly-extending trough immediately adjacent the structural wall, the upper end of the panel extending upwardly into the trough during installation of the panel, the vertical depth of the trough being great enough to allow interengagement and disengagement of the brackets on occasion.

5. Interior decoration system as recited in claim 1, wherein a mop board is applicable to the lower end of the panel and is held in place by a bolt threadedly engaging a nut permanently mounted in the panel, the bolt having a head that engages a vertical groove in the board.

6. Interior decoration system as recited in claim 1, wherein a front face surface of the panel is covered with a flexible decorative sheet, the sheet extending over the vertical edges of the panel and residing in a vertical groove in each vertical edge, and wherein an elastomer strip resides in each groove to lock the sheet in place.

7. Interior decoration system as recited in claim 1, wherein a portion of the panel is provided with a plurality of slats defining T-shaped slots, and wherein a shelf locks into a slot and extends forwardly of the panel to support merchandise for display.

8. Interior decoration system as recited in claim 1, wherein the shelf is formed of clear plastic.

9. Interior decoration system as recited in claim 8, wherein the shelf consists of a straight portion that extends forwardly of the panel, a vertical portion that lies against the outer surface of a slat, a short horizontal portion that lies in the leg of the T-shaped groove, and a short vertical portion that lies in one arm of the same T-shaped groove.

* * * * *